United States Patent [19]

Miller

[11] 4,222,678

[45] Sep. 16, 1980

[54] PRESSURE FED ROLLER TYPE FLUID APPLICATOR

[76] Inventor: Donald W. Miller, 240 Berkeley, Elmhurst, Ill. 60126

[21] Appl. No.: 915,603

[22] Filed: Jun. 15, 1978

[51] Int. Cl.[3] ..... B05C 1/08

[52] U.S. Cl. ..... 401/218; 401/219; 401/208; 15/230.11

[58] Field of Search ..... 401/208, 219, 218, 177, 401/197; 15/230.11

[56] References Cited

U.S. PATENT DOCUMENTS

| | | | |
|---|---|---|---|
| 2,669,743 | 2/1954 | Coughlan | 15/230.11 |
| 2,714,851 | 8/1955 | Schnackel | 401/218 |
| 2,928,113 | 3/1960 | Pedrow | 401/219 |
| 2,955,310 | 10/1960 | Wichern | 401/219 |
| 3,030,652 | 4/1962 | Whitfield et al. | 401/218 |
| 3,134,130 | 5/1964 | Chadwick | 401/208 |
| 3,149,365 | 9/1964 | Adair, Jr. | 401/208 |
| 3,193,868 | 7/1965 | Cassidy | 401/218 |
| 3,340,562 | 9/1967 | Skandaliaris | 401/219 |
| 3,441,355 | 4/1969 | Brown | 401/208 |
| 3,623,179 | 11/1971 | Roth | 15/230.11 |
| 3,711,887 | 1/1973 | Chapman | 15/230.11 |
| 3,751,748 | 8/1973 | Roe et al. | 15/230.11 |
| 3,809,484 | 5/1974 | Bradshaw | 401/208 |
| 3,937,583 | 2/1976 | Tyson et al. | 401/197 |
| 4,077,082 | 3/1978 | Roe et al. | 15/230.11 |
| 4,167,349 | 9/1979 | Testa | 401/177 |

FOREIGN PATENT DOCUMENTS

| | | | |
|---|---|---|---|
| 2007765 | 9/1971 | Fed. Rep. of Germany | 401/219 |

*Primary Examiner*—William Pieprz

*Attorney, Agent, or Firm*—August E. Roehrig, Jr.

[57] ABSTRACT

A pressure fed roller type fluid applicator is disclosed which comprises a frame having a handle and spaced means for supporting thereon in free rolling relation an applicator roller together with a fluid feeder member in the form of an elongate tube of small diameter mounted adjacent the exterior surface of the applicator roller and having a perforated wall so as to discharge liquid onto the exterior surface of the roller, the fluid being supplied through conduit forming means extending from a fluid supply source through the handle and connected to the feeder tube, with a conveniently positioned, manually operable, fluid control valve in the supply line.

5 Claims, 9 Drawing Figures

PRESSURE FED ROLLER TYPE FLUID APPLICATOR

BACKGROUND OF THE INVENTION

This invention relates to applicators for applying paint or similar flowable material to a surface and is more particularly concerned with improvements in roller type applicators which are supplied with flowable material from a compression tank, pure or similar supply source.

Roller type applicators have long been available for use in applying paint or other liquid materials to wall surfaces or other areas. These rollers comprise, basically, a tubular member with a suitable applicator surface and a frame for rotatably supporting the roller which enables the user to apply the liquid to the roller from a shallow pan contaning a supply of the liquid and then roll it upon the surface to be treated. In using this type of applicator, initially, an excess of the liquid is picked up on portions of the roller surface while other portions of the surface fail to pick up sufficient liquid and upon application of the roller to the surface being treated, coverage is spotty with dry spots a likely result. As use of the roller is continued it soon becomes saturated with the liquid material and application to the surface results in the excess paint being thrown off, with resultant splattering, which is objectionable for obvious reasons.

Some roller arrangements have been devised for eliminating the use of the supply pan by feeding the liquid to the interior of a hollow roller from a pressurized supply container which is connected to the roller by a conduit. This type applicator requires a special roller which has a sufficiently porous or perforated wall structure so as to enable the liquid to be conducted to the exterior wall surface for application to the surface being treated. With this arrangement, the roller soon becomes saturated and splattering results. Also, adequate cleaning of the equipment after use is difficult and time consuming.

It is a general object of the present invention to provide a roller applicator arrangement in which the liquid is supplied from a pressure source to the exterior surface of the roller applicator in sufficient quantity and in a manner which will result in satisfactory application of the material to the surface being treated and which enables the user to avoid saturation of the roller and the splattering which results when saturation occurs.

A more specific object of the invention is to provide an improved roller applicator arrangement for applying paint or similar liquid material to the surface wherein a frame is provided for rotatably supporting a cylindrical member having a suitable applicator surface, and also a feeder member which is mounted adjacent the applicator surface and receives material from a pressurized supply source which feeder member includes means to discharge liquid in a uniform manner onto the applicator surface.

Another object of the invention is to provide an improved pressure fed roller arrangement for applying a flowable material wherein a tubular applicator member is mounted for rotation on a supporting frame and a hollow feeder bar is supported adjacent the surface of the applicator member which is connected to a pressurized material supply source and which is apertured so as to discharge the material directly onto the applicator surface.

A further object of the invention is to provide a pressure fed roller applicator wherein a support frame is provided for the roller with end caps which are adapted to accommodate small variations in the roller end diameter.

Still another object of the invention is to provide an improved applicator arrangement for applying a liquid material to a surface wherein an applicator roller is supported on a frame having a hollow handle through which a supply conduit extends for connection with a tubular feeder rod which is mounted adjacent the roller surface and which is perforated so as to discharge the liquid onto the exterior surface of the applicator roller with means for adjusting the position of the feeder rod relative to the roller surface and a valve means to control the flow of liquid to the feeder rod.

The foregoing and other objects and advantages are obtained by the applicator structure herein disclosed and claimed which comprises a frame having means for supporting a roller member with an applicator surface for spreading a flowable material over a surface to be treated and a feeder bar member disposed adjacent the applicator surface with a connection to a pressurized source of material supply and incorporating a means for dispensing the material onto the applicator surface of the roller in a controlled manner.

The invention will be best understood when reference is made to the accompanying detailed description of the preferred embodiment thereof which is set forth therein, by way of example, and to the accompanying drawings wherein like reference numerals indicate corresponding parts throughout.

DESCRIPTION OF THE PREFERRED EMBODIMENTS OF THE INVENTION

Figure 1:
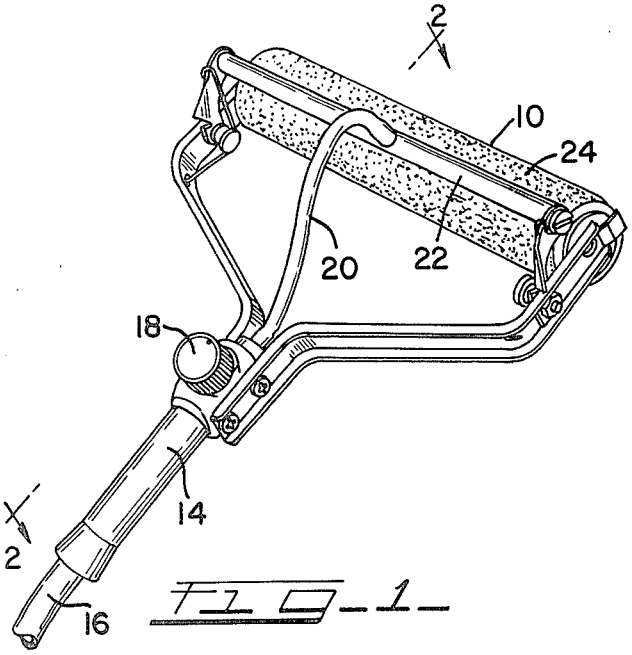
FIG. 1 is a perspective view of a pressure fed applicator assembly for applying paint or similar flowable material which embodies the principal features of the invention.
Figure 10:
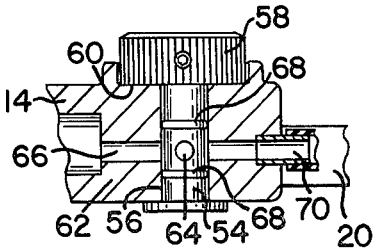
Figure 2:
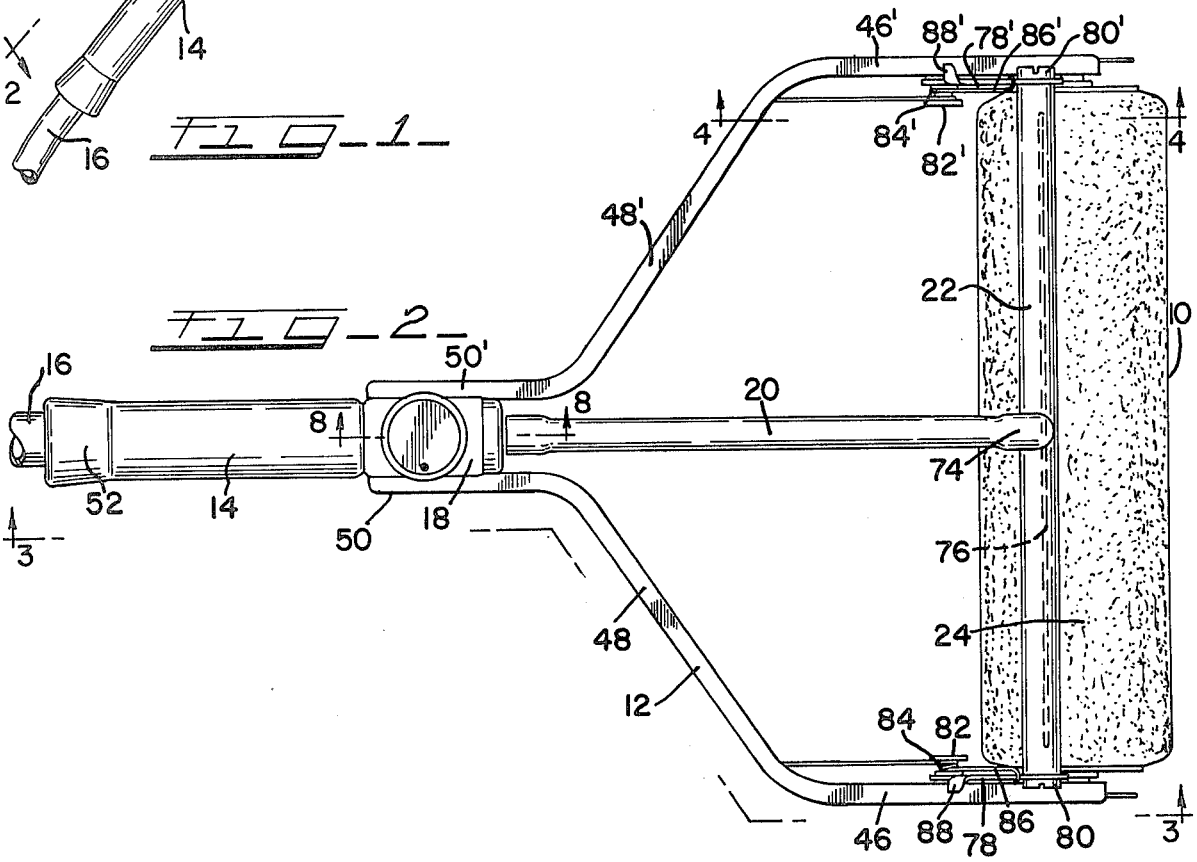
FIG. 2 is a top plan view of the applicator assembly, the view being taken on the line 2—2 of FIG. 1.
Figure 3:
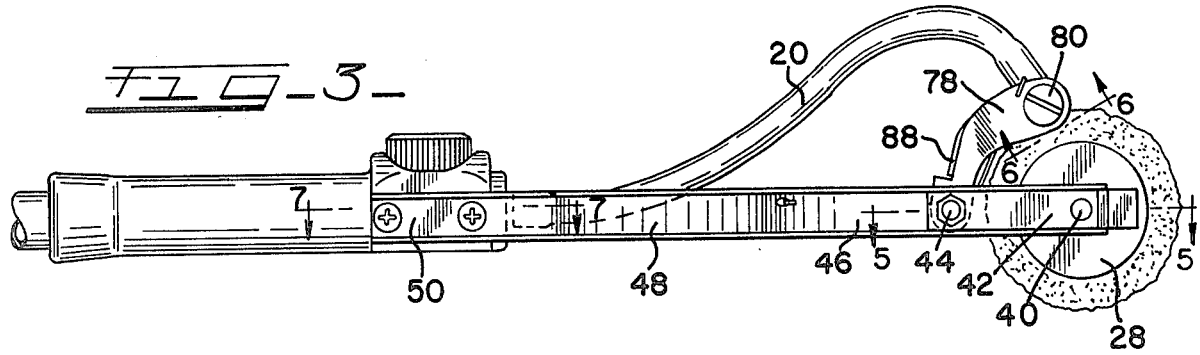
FIG. 3 is a side elevational view of the applicator assembly, the view being taken on the line 3—3 of FIG. 2.
Figure 4:
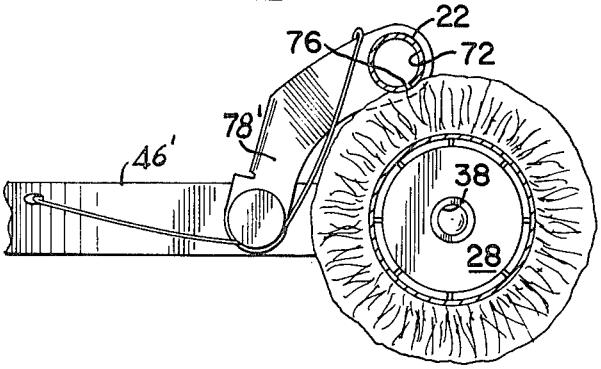
FIG. 4 is a cross sectional view taken on the line 4—4 of FIG. 1, to an enlarged scale.

Referring to the drawings, there is illustrated a preferred form of the applicator device wherein an applicator roller 10 of the type generally supplied for conventional paint roller mounting frames is rotatably supported on a specially designed frame structure 12 which includes a hollow handle structure 14 for connecting thereto, at one end, a material supply conduit 16 running from a source of supply, and having a control valve 18, at the other end, with a connection to a short conduit 20 which extends to a connection with a hollow feeder bar 22, adjustably mounted on the frame 12 so as to extend the axal length of the applicator roller 10 and closely adjacent to the exterior applicator surface 24 and which has a slotted wall enabling direct discharge of the material onto the roller applicator surface.

Figure 5:
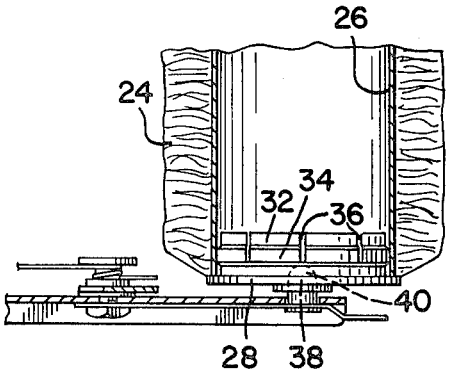
FIG. 5 is a fragmentary sectional view taken on the line 5—5 of FIG. 3.
Figure 6:
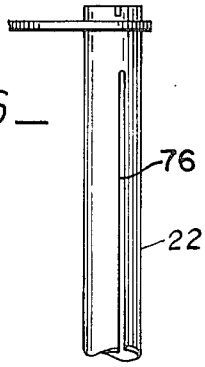
FIG. 6 is a fragmentary view to an enlarged scale, the view being taken on the line 6—6 of FIG. 3 and showing a portion of the metering bar.
Figure 7:
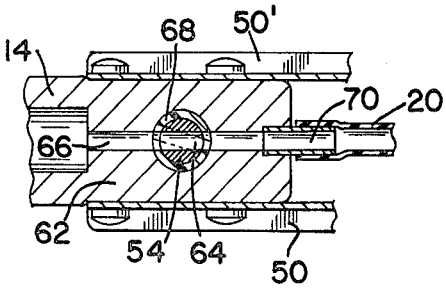
FIG. 7 is a fragmentary section view similar to FIG. 4, but showing a modified structure.

The applicator roller 10 may be the conventional paint applicator roller, obtainable commercially at paint supply outlets, which includes a tubular member 26 (FIG. 5) of an internal diameter, at the ends, which will enable it to be mounted on a standard size roller support frame and having a suitable knap surface 24 on the exterior for application of the paint to the surface to be coated. The roller 10 is open ended and special end caps 28 are provided each of which comprises a circular base portion or plate 30 with a narrow cylindrical flange 32. The flange 32 has an external rib formatifon 34 and is slotted at 36, at spaced points about the periphery, the slots 36 extending normal to the base plate 30. The end caps 38 are formed of a resilient material, such as plastic, or light metal which affords sufficient resiliency to accommodate the variations in diameter found in commercial roller members of this type. The base portion is formed with a central aperture 38 for receiving a mounting pin or button 40 which is carried on the free end of a leaf spring member 42 having its other end secured at 44 to an outside face of the associated support frame member 46 or 46'. The central aperture 38 functions as a bearing to allow the roller 10 to rotate about the mounting pins 40.

The support frame structure 12 comprises the two spaced, parallel arm members or portions 46, 46' for supporting the roller 10. The arm members are spaced a distance apart according to the axial dimension of the roller 10 which it is desired to accommodate. The arm portions 46, 46' are connected by frame portions 48, 48', which are disposed in converging relation, to relatively short parallel frame portions 50, 50' which are spaced so as to secure between them the innermost end of the handle section 14 which incorporates the control valve 18. The frame portions may be of light metal, plastic, or the like, and for rigidity may be channel-shaped as shown. The handle portion 14 is in the form of a hollow tube with a suitable connection at the free end 52 for joining to the supply conduit 16. At the other end, in the form shown, there is a built-in valve structure 18 formed by a barrel-like stem portion 54 (FIG. 8) seated in rotatable relation in a cross bore 56. The valve 18 controls the flow of fluid to the applicator roller 10, functioning to control both the rate of flow as well as turning the supply on or off. The stem portion 54 has an operating knob 58 of larger diameter removably secured on one end by a set screw or other suitable means which is disposed in a recess 60 in the housing formation 62 and a retaining flange on the other end which cooperates with the knob 58 in holding the stem 54 properly seated in the bore 56. The cross bore 64 is positioned in the stem 54 for alignment with an axial fluid passageway 66 extending in the housing formation 62 upon predetermined rotation of the knob 58 to open the valve. A pair of axially spaced O-ring seals 68 on opposite sides of the bore 64 prevent leakage along the stem 54. The passageway 66 connects the supply conduit with the feeder conduit 20 by means of a suitable connector element 70.

The feeder bar 22, which is in the form of a small diameter tube 72, is of approximately the same axial dimension as the applicator roller 10 and which is supported adjacent and in contact with the knap on the exterior surface 24 of the roller 10, has a connection at 74 with the feeder conduit 20, which connection is intermediate the ends of the tube and on the side opposite the side which confronts or engages the knap of the roller. The knap confronting side of the tube 72 is axially slotted at 76 throughout the greater portion of its axial dimension so as to provide a narrow elongate opening for discharging the material directly onto the applicator exterior surface. The feeder bar 22 is mounted at its opposite ends on a pair of support arms 78, 78' by means of screws 80, 80' which are in threaded engagement in the tube ends and seal the same against leakage of the material. The tube support arms 78, 78' are mounted on the roller support arms 46, 46' of the frame structure 12 by means of bolt members 82, 82' which also serve to secure the leaf springs 42, 42'. The bolt members 82, 82' have circumferentially grooved heads for carrying thereon torsion spring members 84, 84' each of which has one end portion 86, 86' secured to the associate support arm 78, 78', near the connection with the tube 72, and the other end secured to the associated frame portion 48, 48' so as urge the feeder bar 22 in the direction of the roller 10.

Turned over or turned out lug forming portions 88, 88' on the arms 78, 78' provide stop members for engaging the arms 46, 46' in order to limit the movement of the arms 78, 78' and prevent possible breakage of the springs 84, 84'.

Figure 8:
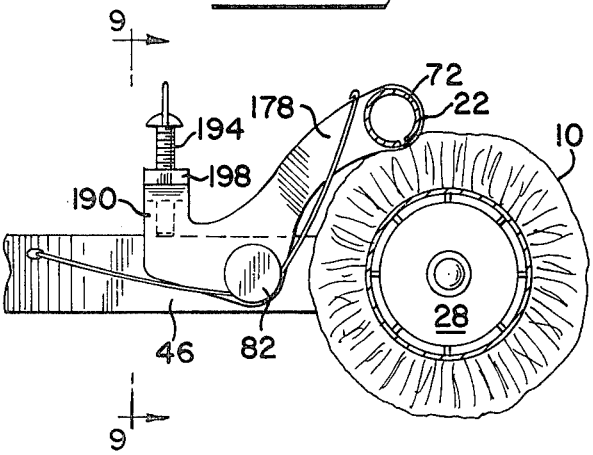
FIG. 8 is a fragmentary sectional view similar to FIG. 4, but showing a modified structure.
Figure 9:
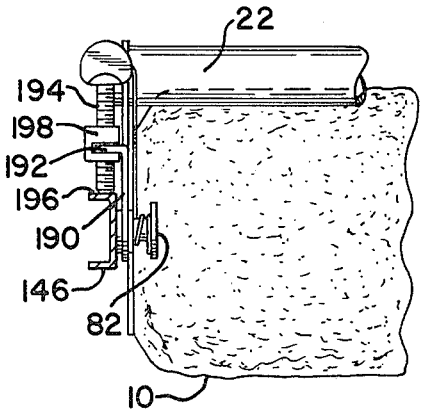
FIG. 9 is a fragmentary sectional view taken on the line 9—9 of FIG. 8.

In a modified construction shown in FIGS. 8 and 9, each of the feeder tube support arms, one of which is illustrated at 178, include an angular extension or wing portion 190 having an outwardly directed flange member 192 which is positioned to overlie or extend outwardly above the top edge of the frame arm member 146 on which the roller 10 is supported. The flange member 192 is apertured to receive a bolt 194 with the free end of the bolt engaging the top edge 196 of the frame member 146. The bolt 194 carries a slotted nut 198 encompassing the flange member 192 so that rotation of the bolt 194 adjusts the position of the end of the tube 72 relative to the knap surface of the roller 10 and enables parallelism to be maintained.

The manner in which the device may be used will be obvious from the description of the same. The slotted feed bar results in the application of the material to the roller surface in a uniform manner and with the valve arrangement in the supply line enables the user to meter the material so as to avoid saturation of the knap and thereby eliminate objectionable splattering while supplying sufficient material to obtain satisfactory coating of the surface being treated. The mounting of the applicator roller on the frame by means of the spring mounted trunnion forming pins or buttons 40 and the associated roller end cap members 38 permits the use of conventional paint rollers which are readily available commercially.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. A roller type application device for applying a paint or other flowable material to a surface which device comprises an applicator roller, a frame having a handle forming portion and spaced arm members having means for rotatably supporting said roller, means for feeding material to the roller surface which is in the form of a relatively small diameter tube mounted relative to said roller so as to extend generally parallel to the axis of rotation of the roller and substantially in contact with the exterior surface of said roller, which feeder tube is apertured so as to discharge material supplied thereto onto the roller surface substantially throughout the axial dimension of the roller, said aperture in said feeder tube being in confrontation to said applicator surface and is formed as a slot extending substantially the length thereof for uniformly passing paint or other flowable material therethrough for application throughout substantially the axial dimension of the roller surface, means connected to said material feeding tube for supplying material to said tube and a valve for controlling the feeding of said material to said tube, said spaced arm members have means for supporting said roller which includes releaseable trunnion forming members and associated end caps for said roller which end caps include an aperture and compressible roller engaging flange portion for accommodating variations in the diameter of the roller, said releaseable trunnion includes a flexible flat member and a pin mounted thereon, said flat member urging said pin into engagement in said aperture for releaseable support of said roller, means for securing said flat member to said spaced arm members at a position spaced from said pin, said tube for feeding material to the roller surface is mounted at its ends on spring pressed arm members having means for adjusting the position of said tube relative to the surface of the applicator roller, said tube mounting arm members are pivoted on said frame and have associated torsion springs for urging the tube in the direction of the roller surface, and said torsion springs having an intermediate portion coupled to said means for securing said flat member and an end portion coupled to said tube for feeding material.

2. A roller type applicator device as set forth in claim 1 wherein the handle forming portion of said frame is a hollow member and constitutes a part of said means for supplying material to said tube.

3. A roller type applicator device as set forth in claim 1 wherein said valve for controlling the feeding of said material to said tube is mounted on said roller supporting frame.

4. A roller type applicator device as set forth in claim 3 wherein said valve for controlling the feeding of material to said tube is built into said handle portion of said frame.

5. A roller type applicator device as set forth in claim 1 wherein said spaced arm members have means for supporting said roller which includes releasable trunnion forming members for mounting said roller on said arm members.

* * * * *